US007073488B2

(12) United States Patent
Hasler et al.

(10) Patent No.: US 7,073,488 B2
(45) Date of Patent: Jul. 11, 2006

(54) CYLINDER CUTOUT STRATEGY FOR ENGINE STABILITY

(75) Inventors: Gregory S. Hasler, Pekin, IL (US); David L. Zwetz, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 114 days.

(21) Appl. No.: 10/386,182

(22) Filed: Mar. 11, 2003

(65) Prior Publication Data

US 2004/0177836 A1 Sep. 16, 2004

(51) Int. Cl.
*F02D 13/06* (2006.01)
*F02D 17/02* (2006.01)

(52) U.S. Cl. ..... 123/481; 123/198 F; 123/198 DB

(58) Field of Classification Search ..... 123/481, 123/198.08, 198 F; 701/112
See application file for complete search history.

(56) References Cited

U.S. PATENT DOCUMENTS

| | | | | | |
|---|---|---|---|---|---|
| 4,489,684 | A | | 12/1984 | Yamada | |
| 4,492,191 | A | | 1/1985 | Aoki et al. | |
| 4,781,160 | A | | 11/1988 | Lohr et al. | |
| 4,962,740 | A | * | 10/1990 | Fujimoto et al. | 123/481 |
| 4,967,727 | A | | 11/1990 | Takahashi et al. | |
| 5,035,220 | A | * | 7/1991 | Uchinami et al. | 123/436 |
| 5,579,736 | A | | 12/1996 | Nakamura et al. | |
| 5,645,032 | A | * | 7/1997 | Motose | 123/339.16 |
| 5,758,616 | A | | 6/1998 | Motose | |
| 5,797,371 | A | * | 8/1998 | Nonaka | 123/481 |
| 5,826,563 | A | | 10/1998 | Patel et al. | |
| 5,827,150 | A | * | 10/1998 | Mukumoto | 477/101 |
| 5,868,116 | A | | 2/1999 | Betts et al. | |
| 5,899,189 | A | * | 5/1999 | Adelsperger et al. | 123/436 |
| 5,970,951 | A | * | 10/1999 | Ito | 123/335 |
| 6,009,857 | A | | 1/2000 | Hasler et al. | |
| 6,098,592 | A | | 8/2000 | Hess et al. | |
| 6,125,812 | A | | 10/2000 | Garabedian | |
| 6,158,218 | A | | 12/2000 | Herold et al. | |
| 6,336,440 | B1 | * | 1/2002 | Schmitz et al. | 123/406.27 |
| 6,367,443 | B1 | | 4/2002 | Bassi et al. | |
| 6,401,684 | B1 | | 6/2002 | Hori et al. | |
| 6,435,156 | B1 | | 8/2002 | Copus | |
| 6,484,686 | B1 | | 11/2002 | Ordanic | |
| 6,520,158 | B1 | | 2/2003 | Mills | |
| 6,823,835 | B1 | * | 11/2004 | Dunsworth et al. | 123/305 |
| 2001/0013330 | A1 | | 8/2001 | Grizzle et al. | |

FOREIGN PATENT DOCUMENTS

| | | | |
|---|---|---|---|
| JP | 126236 | * | 5/1993 |

* cited by examiner

*Primary Examiner*—Hai Huynh
(74) *Attorney, Agent, or Firm*—Liell & McNeil

(57) ABSTRACT

A method for controlling operation of an engine having a plurality of cylinders. The method includes monitoring a parameter associated with engine operation, determining a range of fluctuation of the parameter from a desired parameter value, and selectively disabling operation of at least one cylinder and less than all of the plurality of cylinders in response to the range of fluctuation being greater than a predetermined threshold.

14 Claims, 3 Drawing Sheets

CYLINDER CUTOUT STRATEGY FOR ENGINE STABILITY

TECHNICAL FIELD

This invention relates generally to a method for selective cutout of one or more cylinders of an engine and, more particularly, to a method for determining a fluctuation of an engine parameter and selectively disabling one or more cylinders in response to the fluctuation.

BACKGROUND

It has long been known that one or more cylinders of a multiple cylinder engine may be disabled from normal operation, i.e., cutout, to achieve a desired objective. For example, it is a widely followed practice to periodically cutout a cylinder for a brief period of time to monitor resultant engine operating conditions and thus determine if the cylinder and associated components are functioning within acceptable limits.

Cylinder cutout techniques may be employed for other purposes as well. For example, in U.S. Pat. No. 6,009,857, Hasler et al. disclose a system in which one or more cylinders are disabled to reduce the occurrence of white smoke. Engine speed and coolant temperature are monitored and when conditions exist which would cause white smoke, a fractional percentage of the cylinders are cutout.

There are engine operating conditions which may exist in which an engine may run unstable, i.e., the speed of the engine may fluctuate more than allowable from a desired speed. For example, an engine running at an idle speed, e.g., a marine engine at idle, may tend to fluctuate from the desired idle speed due to nonlinearities associated with operating parameters such as fuel delivery. These fluctuations in speed are often undesirable and it would be preferable to cause the engine to operate under more linear portions of operating curves to reduce the fluctuations.

The present invention is directed to overcoming one or more of the problems as set forth above.

SUMMARY OF THE INVENTION

In one aspect of the present invention a method for controlling operation of an engine having a plurality of cylinders is disclosed. The method includes the steps of monitoring a parameter associated with engine operation, determining a range of fluctuation of the parameter from a desired parameter value, and selectively disabling operation of at least one cylinder and less than all of the plurality of cylinders in response to the range of fluctuation being greater than a predetermined threshold.

In another aspect of the present invention a method for controlling operation of an engine having a plurality of cylinders and a corresponding one of a plurality of fuel injectors for each cylinder is disclosed. The method includes the steps of monitoring a parameter associated with engine operation, determining a range of fluctuation of the parameter from a desired parameter value, selectively disabling a delivery of fuel from at least one fuel injector and less than all of the plurality of fuel injectors to a corresponding at least one cylinder in response to the range of fluctuation being greater than a predetermined threshold, and increasing a delivery of fuel from a normal operating value to an increased operating value from each of the remaining enabled fuel injectors to each corresponding enabled cylinder.

In yet another aspect of the present invention a method for controlling operation of an engine having a plurality of cylinders is disclosed. The method includes the steps of monitoring a speed of the engine, determining a range of fluctuation of the engine speed from a desired engine speed, selectively disabling operation of at least one cylinder and less than all of the plurality of cylinders in response to the range of fluctuation being greater than a predetermined threshold, and enabling operation of each of the plurality of cylinders in response to the range of fluctuation being less than the predetermined threshold.

DETAILED DESCRIPTION

Figure 1:
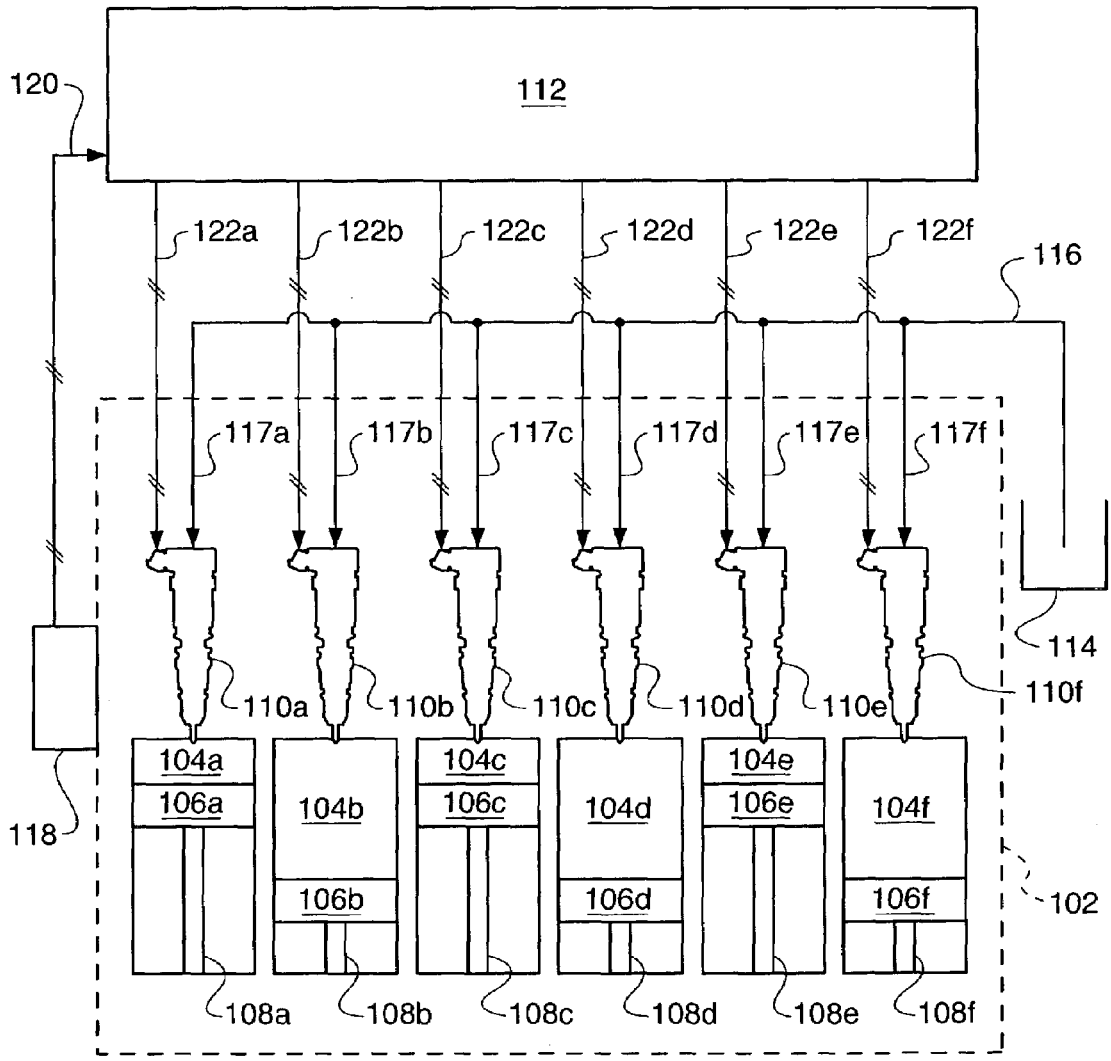
FIG. 1 is a diagrammatic illustration of an engine suited for use with the present invention.

Referring to the drawings, a method for controlling operation of an engine 102 is shown. With particular reference to FIG. 1, a diagrammatic illustration of an engine 102 suited for use with the present invention is shown. The engine 102 includes a plurality of cylinders 104. For example, FIG. 1 depicts six cylinders 104*a–f*. However, any number of cylinders more than one may be used. For example, the engine 102 may have two, four, eight, ten, twelve, or some other number of cylinders.

Associated with each cylinder 104 is a piston 106, for example six pistons 106*a–f*. Each piston 106 may be drivably connected to a connecting rod 108. Thus, the six cylinder engine 102 of FIG. 1 includes six pistons 106*a–f*, each piston 106 being connected to a corresponding one of six connecting rods 108*a–f*. The connecting rods 108*a–f* may be connected to a crankshaft (not shown) in a manner well known in the art.

Each cylinder 104 may receive fuel by way of a fuel injector 110. As FIG. 1 shows, each of the six cylinders 104*a–f* is associated with a corresponding one of six fuel injectors 110*a–f*. Each of the six fuel injectors 110*a–f* may receive fuel from a corresponding fuel injector supply line 117*a–f*, which in turn may receive fuel from a fuel line 116 connected to a fuel supply 114. It is well known in the art that additional components, e.g., pumps, filters, and the like may also be included to supply fuel to the fuel injectors 110*a–f*. Furthermore, variations of the fuel supply configuration described above may be used as well, e.g., the fuel line 116 and the injector fuel supply lines 117*a–f* may be configured as independent lines, a common rail system, and the like.

A controller 112 may receive information regarding a parameter associated with engine operation, e.g., a parameter associated with a speed of the engine 102. More specifically, the controller 112 may receive signals from a speed sensor 118 by way of a sensor signal line 120. Examples of speed sensors suited for use include, but are not limited to, angular position sensors at a location near a crankshaft or drive train, detonation sensors located near a cylinder, and the like.

Alternatively, the controller 112 may receive information indicative of parameters other than engine speed, e.g., fuel delivery information, engine load information, and the like, and may determine engine speed from the received information.

The controller 112 may be further configured to deliver command information to the fuel injectors 110*a–f* by way of respective control signal lines 117*a–f*. Control signals may include such information as timing commands for fuel injection, current duration commands for duration of injection of fuel, injector enable and disable commands, and the like.

Figure 2:
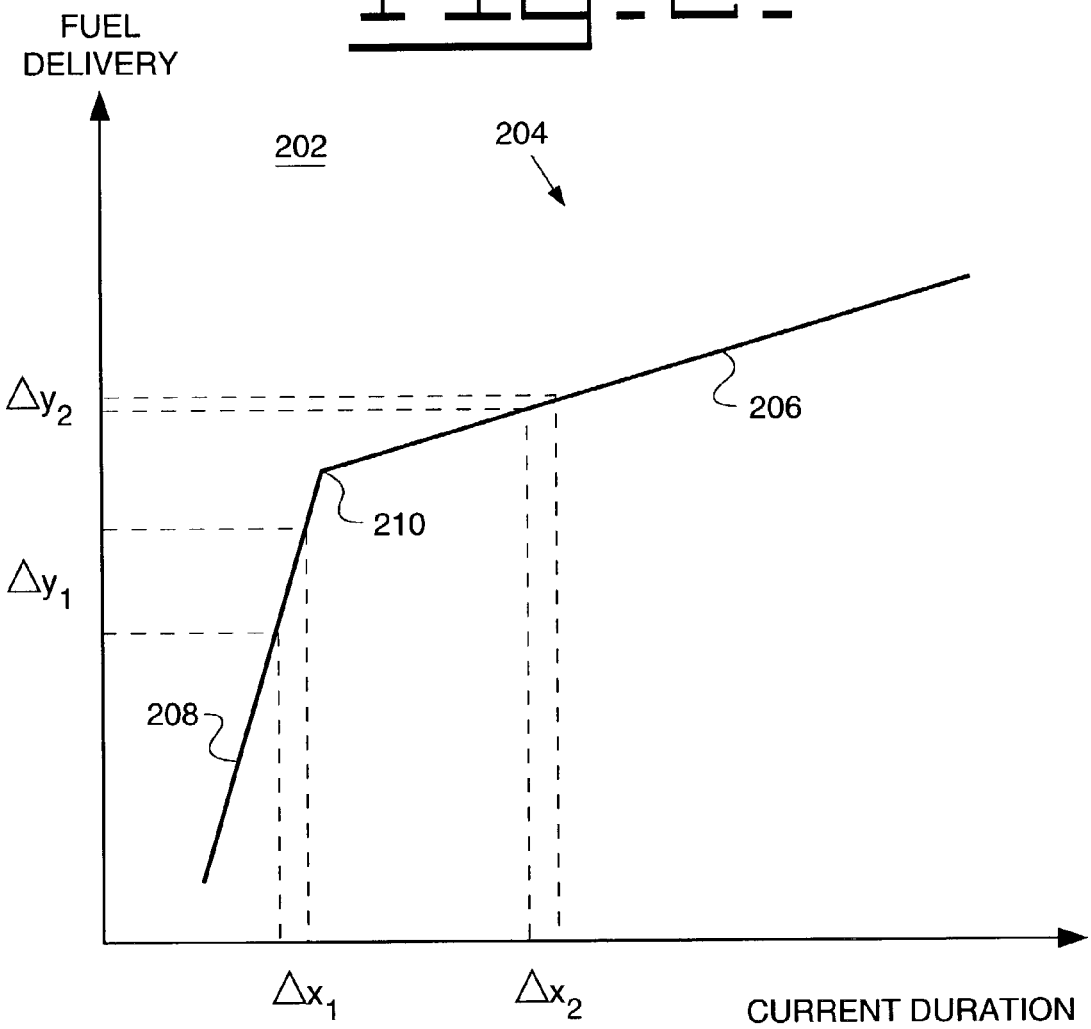
FIG. 2 is a graph illustrating an exemplary fuel delivery curve for a fuel injector.

Referring to FIG. 2, a graph 202 indicating an exemplary fuel delivery curve 204 for an injector 110 is shown. The graph 202 may be a plot of current duration or injector on-time vs. fuel delivery of an injector. A typical plot includes a curve 204 having a relatively flat portion 206, i.e., a portion of the curve 204 having a fairly flat slope. The curve 204 may also have a relatively steep portion 208, i.e., a steep slope, separated from the flat portion 206 by a knee portion 210.

Operation of the fuel injector 110 may be characterized by stable delivery of fuel when the current duration is high enough to place operation on the flat portion 206. More specifically, a variation in current duration $\Delta x_2$ may result in a corresponding small variation in fuel delivery $\Delta y_2$. However, when operation is below the knee portion 210, i.e., on the steep portion 208, delivery of fuel may become unstable. For example, a variation in current duration $\Delta x_1$ of the same magnitude as $\Delta x_2$ results in a variation in fuel delivery $\Delta y_1$ that is much greater than $\Delta y_2$. It is thus preferred to maintain current duration in the flat portion 206 of the curve 204, i.e., above the knee portion 210.

INDUSTRIAL APPLICABILITY

Figure 3:
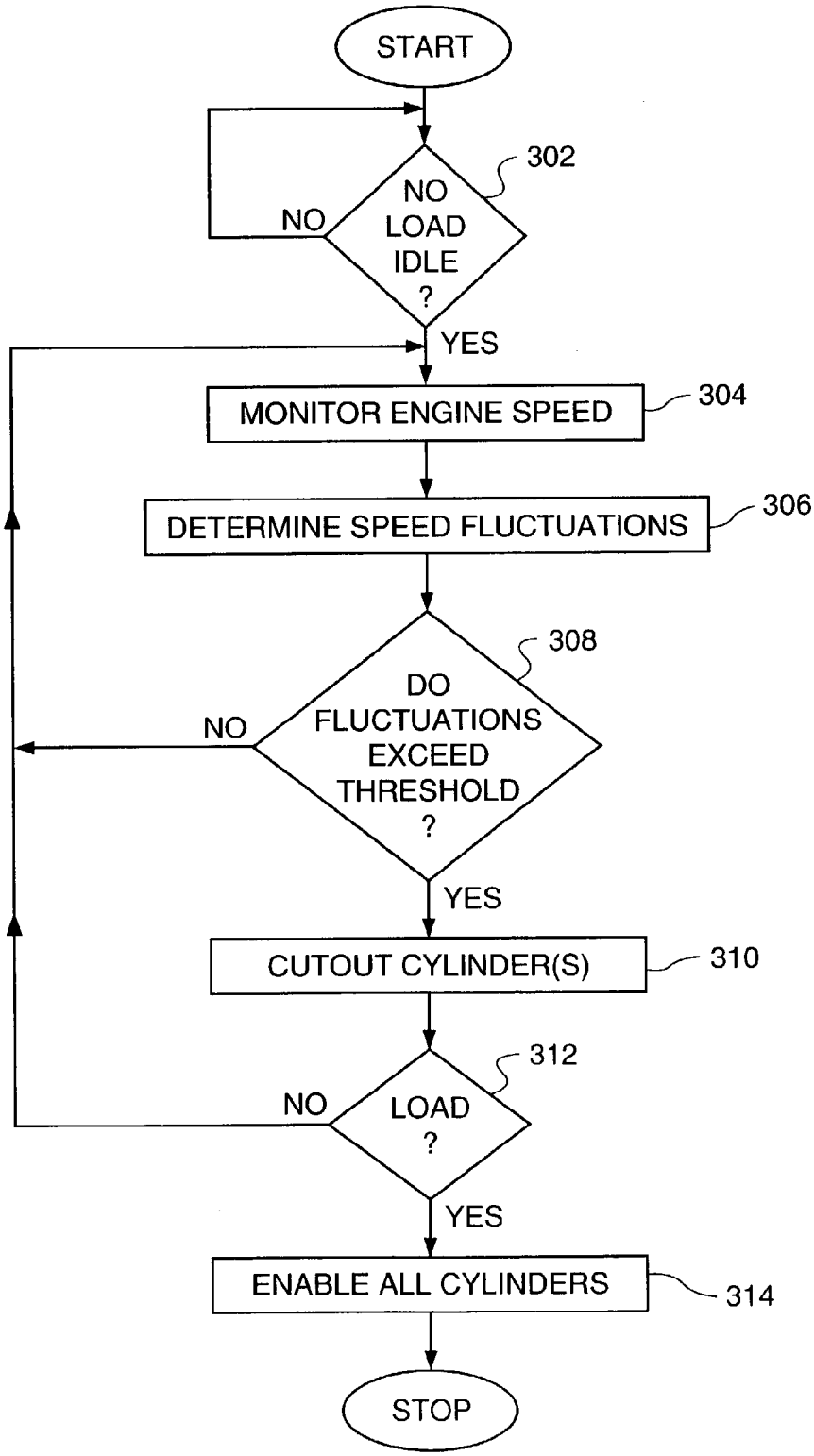
FIG. 3 is a flow diagram illustrating a preferred method of the present invention.

Referring to FIG. 3, a flow diagram illustrating a preferred method of the present invention is shown. The steps embodied in the flow diagram serve as an example of use of the present invention with an engine.

In a first decision block 302, an operating condition of the engine 102 is determined. More particularly, it is determined whether the engine 102 is in a no load idle condition. The no load condition may correspond to the engine 102 being in neutral. For example, a marine engine may be required to operate at no load and at idle for periods of time before actuating a throttle and applying a load to the engine.

Continuing with the example of a marine engine, typical engines of this type may not have a direct means to determine when the engine is in neutral. An alternative method may be to monitor fuel delivery, since fuel delivery may be based on throttle position and load. When fuel delivery levels fall below a specified value, it may be determined that the engine is in neutral. In addition, when the engine speed falls below another specified value, it may be determined that the engine is at idle. Under these circumstances, it may be determined that the operating condition of the engine is in a no load idle condition. Fuel delivery may be monitored by monitoring command signals for fuel delivery, such as current duration, injector on-time, and the like.

If a no load idle condition is determined, control proceeds to a first control block 304, in which the speed of the engine 102 is monitored, for example by a signal from a speed sensor 118 as described above. In a second control block 306, fluctuations in engine speed are determined. The fluctuations in engine speed may be indicative of fluctuations in fuel delivery, as shown in the graph 204 of FIG. 2.

In a second decision block 308, it is determined whether the engine speed fluctuations exceed a threshold. For example, a desired engine speed at idle may be 550 rpm. It may be established that a range of fluctuation from 540 rpm to 560 rpm may be allowed as a threshold range. Thus, if it is found that the range of fluctuation is from 530 rpm to 570 rpm, it would be determined that the predetermined threshold has been exceeded.

If the threshold is exceeded, control proceeds to a third control block 310, in which one or more cylinders are cutout. For example, if the engine has six cylinders, one, two, or three cylinders may be cutout. Referring briefly to FIG. 2, if one or more cylinders are cutout, the controller 112 will determine a drop in engine speed since the engine is generating less power. The controller 112 may then increase the current duration to the remaining active cylinders, which in turn moves fuel delivery operation to the flat portion 206 of the curve 204, thus reducing fuel delivery fluctuations and engine speed fluctuations. If disabling one cylinder is not sufficient, then a second cylinder may be cutout, and so on. Preferably, a cylinder is cutout by disabling delivery of fuel by a corresponding fuel injector.

The controller 112 continues to monitor the engine operating condition and, in a third decision block 312, if it is determined that a load has been applied, e.g., the engine is no longer in neutral, control proceeds to a fourth control block 314, in which all cylinders are enabled for normal operation.

Other aspects can be obtained from a study of the drawings, the disclosure, and the appended claims.

What is claimed is:

1. A method for controlling operation of an engine having a plurality of cylinders, comprising the steps of:

determining an engine load is within a predetermined unstable range;

monitoring a parameter specific to engine operation and indicative of engine speed;

determining a range of fluctuation of the parameter from a desired parameter value; and selectively disabling operation of at least one cylinder and less than all of the plurality of cylinders in response to the range of fluctuation being greater than a predetermined threshold.

2. A method, as set forth in claim 1, further including the step of enabling operation of each of the plurality of cylinders in response to determining the engine load is not within the predetermined range.

3. A method, as set forth in claim 1, wherein determining a range of fluctuation includes the step of determining a range of fluctuation of the engine speed from a desired engine speed.

4. A method, as set forth in claim 1, further including the step of increasing a delivery of fuel to each enabled cylinder in response to at least one cylinder being selectively disabled.

5. A method for controlling operation of an engine having a plurality of cylinders, comprising the steps of:

determining an operating condition of the engine;

monitoring a parameter specific to engine operation;

determining a range of fluctuation of the parameter from a desired parameter value;

selectivity disabling operation of at least one cylinder and less than all of the plurality of cylinders in response to the range of fluctuation being greater than a predetermined threshold; and enabling operation of each of the plurality of cylinders in response to determining a change in the determined operating condition of the engine;

wherein determining an operating condition of the engine includes the step of determining a no load idle operating of the engine.

6. A method, as set forth in claim 5, wherein determining a change in the determined operating condition of the engine includes the step of determining a load being applied to the engine.

7. A method for controlling operation of an engine having a plurality of cylinders and a corresponding one of a plurality of fuel injectors for each cylinder, comprising the steps of:

determining an operating condition of the engine;

monitoring a parameter specific to engine operation and indicative of engine speed;

determining a range of fluctuation of the parameter from a desired parameter value;

reducing the range of fluctuation of the parameter at least in part via a step of selectively disabling a delivery of fuel from at least one fuel injector and less than all of the plurality of fuel injectors to a corresponding at least one cylinder, and a step of selectivity increasing a delivery of fuel from a normal operating value to an increased operating value from each of the remaining enabled fuel injectors to each corresponding enabled cylinder.

8. A method, as set forth in claim 7, wherein determining an operating condition of the engine comprises the step of determining a no load idle condition of the engine, and determining a range of fluctuation includes the step of determining a range of fluctuation of an engine speed from a desired engine idle speed.

9. A method for controlling operation of an engine having a plurality of cylinders and a corresponding one of a plurality of fuel injectors for each cylinder comprising the steps of :

determining an operation condition of the engine;

monitoring a parameter specific to engine operation;

determining a range of fluctuation of the parameter from a desired parameter value;

selectivity disabling a delivery of fuel from at least one fuel injector and less than all of the plurality of fuel injectors to a corresponding at least one cylinder in response to the range of fluctuation being greater than a predetermined threshold; and increasing a delivery of fuel from a normal operating value to an increased operating value from each of the remaining enabled fuel injectors to each corresponding enabled cylinder; wherein determining an operating condition of the engine includes the step of determining a no load idle operating condition of the engine.

10. A method, as set forth in claim 9, further including the step of enabling a delivery of fuel at the normal operating value from each fuel injector in response to determining a load being applied to the engine.

11. A method for controlling operation of an engine having a plurality of cylinders, comprising the steps of:

determining a no load idle operating condition of the engine;

monitoring a speed of the engine;

determining a range of fluctuation of the engine speed from a desired engine speed;

selectively disabling operation of at least one cylinder and less than all of the plurality of cylinders in response to the range of fluctuation being greater than a predetermined threshold; and enabling operation of each of the plurality of cylinders in response to determining a load being applied to the engine.

12. The method of claim 11 further including the step of decreasing a fuel delivery fluctuation in at least one enabled cylinder during the no load idle operating condition by increasing the duration of a control current to a fuel injector disposed at least partially therein.

13. The method of claim 11 wherein the selectively disabling step includes selectively disabling a first one of the plurality of cylinders, and wherein the method further includes the steps of:

determining a range of fluctuation of the engine speed from a desired speed, after selectively disabling the first one of the plurality of cylinders; and selectively disabling another one of the plurality of cylinders, in response to the range of fluctuation being greater than the predetermined threshold, after selectively disabling the first one of the plurality of cylinders.

14. The method of claim 11 wherein the step of determining the engine is in a no load idle condition includes:

the step of determining that a fuel delivery level to the engine is below a predetermined value; and the step of determining that an engine speed is below another predetermined value.

* * * * *